US009353645B1

(12) United States Patent
Kennedy

(10) Patent No.: US 9,353,645 B1
(45) Date of Patent: May 31, 2016

(54) VANE RING THERMAL STRAIN RELIEF CUTS

(71) Applicant: BorgWarner Inc., Auburn Hills, MI (US)

(72) Inventor: Donald Michael Kennedy, Asheville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 14/623,256

(22) Filed: Feb. 16, 2015

(51) Int. Cl.

| | |
|---|---|
| ***F01D 25/14*** | (2006.01) |
| ***F01D 9/02*** | (2006.01) |
| ***F01D 17/16*** | (2006.01) |
| ***F01D 9/04*** | (2006.01) |

(52) U.S. Cl.
CPC ..... *F01D 25/14* (2013.01); *F01D 9/041* (2013.01); *F01D 17/16* (2013.01); *F05D 2220/40* (2013.01); *F05D 2260/30* (2013.01)

(58) Field of Classification Search
CPC ..... F01D 9/041; F01D 17/16; F01D 17/162; F01D 17/165; F01D 17/167; F01D 25/14
See application file for complete search history.

(56) References Cited

U.S. PATENT DOCUMENTS

| | | | | |
|---|---|---|---|---|
| 4,726,744 | A * | 2/1988 | Arnold | 417/407 |
| 7,553,127 | B2 * | 6/2009 | Noelle | 415/164 |
| 7,571,607 | B2 * | 8/2009 | Vrbas | 60/605.1 |
| 8,104,280 | B2 * | 1/2012 | Akita | 60/602 |
| 8,262,346 | B2 * | 9/2012 | Wengert et al. | 415/163 |
| 8,919,119 | B2 * | 12/2014 | Sun et al. | 60/602 |
| 2011/0014032 | A1 * | 1/2011 | Boening | F01D 17/165 415/148 |
| 2012/0082539 | A1 * | 4/2012 | Mohiki | 415/159 |

* cited by examiner

*Primary Examiner* — Igor Kershteyn
*Assistant Examiner* — Christopher R Legendre
(74) *Attorney, Agent, or Firm* — BrooksGroup

(57) ABSTRACT

A product for a turbocharger assembly is disclosed. A turbine wheel assembly may be adapted to rotate when exposed to a flow of gas. A vane ring may be disposed in the turbine wheel assembly. A plurality of vanes may be mounted to the vane ring. The flow of gas may meet the plurality of vanes at an angle of incidence. The plurality of vanes may be adjustable to selectively change the angle of incidence. The vane ring may have at least one slot adapted to direct a thermal deformation of the vane ring in a selected direction when exposed to the flow of gas.

12 Claims, 1 Drawing Sheet

VANE RING THERMAL STRAIN RELIEF CUTS

TECHNICAL FIELD

The field to which the disclosure generally relates includes turbochargers for internal combustion engines and more particularly includes turbochargers with variable turbine geometry.

BACKGROUND

Turbochargers may be employed with internal combustion engines to pre-charge combustion air. A turbocharger system may include a compressor wheel driven by a turbine wheel. The turbine wheel may be connected to the compressor wheel by a common shaft that is supported for rotation by bearings. Rotation of the turbine wheel drives the compressor wheel through the common shaft to charge the combustion air. The turbocharger's wheels and the connected shaft may rotate at speeds that approach hundreds of thousands of revolutions per minute. In addition, the turbine wheel operates in a high temperature exhaust gas environment, wherein heat may be transferred to the other turbocharging system components. Under these harsh, and increasingly demanding operating conditions, the turbocharging system components are expected to operate for a lifespan of many years during which they continue to function with the engine to which the system is applied. To perform as expected, the design of the turbocharging system components must be robust to survive as expected, while still being cost effective.

SUMMARY OF ILLUSTRATIVE VARIATIONS

A number of variations may involve a product for a turbocharger assembly that may include a turbine wheel assembly that may be adapted to rotate when exposed to a flow of gas. A vane ring may be disposed in the turbine wheel assembly. A plurality of vanes may be mounted to the vane ring. The flow of gas may meet the plurality of vanes at an angle of incidence. The plurality of vanes may be adjustable to selectively change the angle of incidence. The vane ring may have at least one slot adapted to direct a thermal deformation of the vane ring in a selected direction when exposed to the flow of gas.

Other illustrative variations within the scope of the invention will become apparent from the detailed description provided herein. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses.

Figure 1:
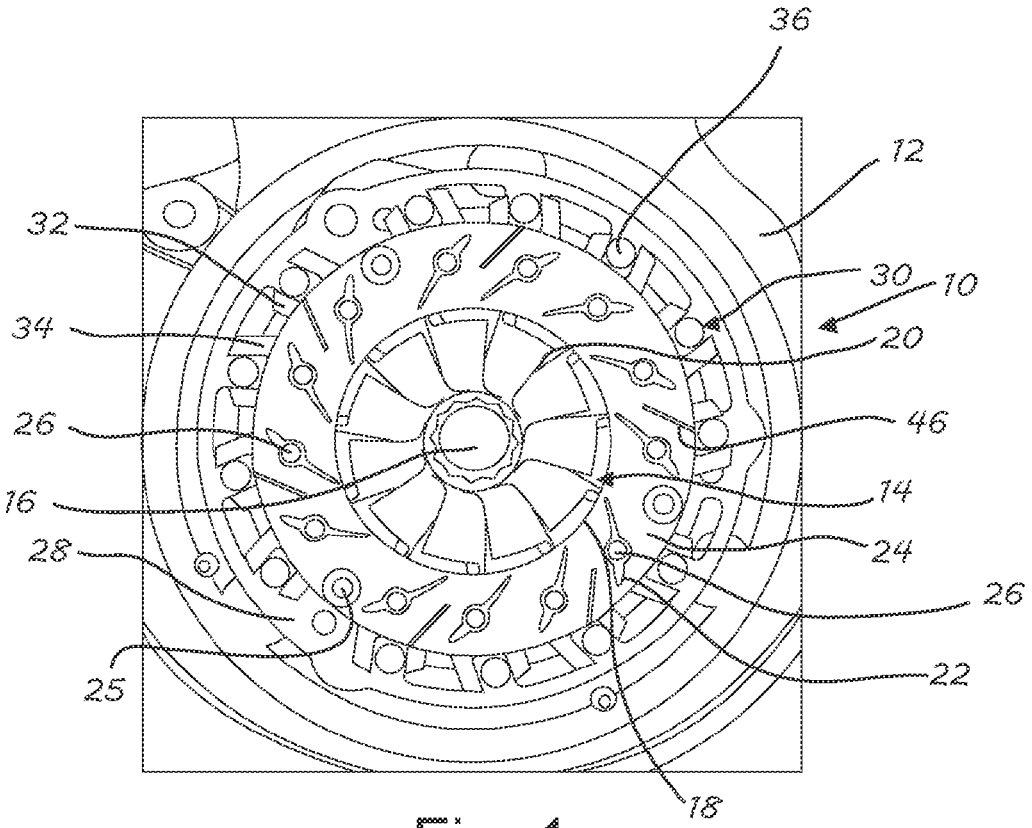
FIG. 1 is a fragmentary illustration of a turbine area of a turbocharger with vanes in an open state according to a number of variations, and with the turbine housing removed.

In a number of illustrative variations a turbocharger assembly 10 as shown in FIG. 1 may include a housing 12 within which a turbine wheel assembly 14 may be rotatably mounted on a shaft 16. The turbine wheel assembly 14 may be covered by a turbine housing (not shown), which directs exhaust gas onto the turbine wheel assembly's outer circumference. The turbine wheel assembly 14 may exist in a continuous high velocity jet of exhaust gases entering when the engine is running, which imparts rotation before exiting to an exhaust system. As a result, the turbine wheel assembly 14 may be exposed to extremely high temperatures that can fluctuate rapidly. The turbine wheel assembly 14 may include a center hub 18 with a number of fixed outlet vanes 20 that radiate around the shaft 16 and that may direct exhaust gases out from the turbine.

The turbine wheel assembly 14 may provide variable turbine geometry by means of a number of variable inlet vanes 22 each rotatably disposed around a vane ring 24 by a shaft 26. The vane ring 24 may be mounted in the turbine wheel assembly by a number of fasteners 25, in this case three fasteners. The vanes 22 may have an aerodynamic shape in the nature of a modified air foil, selected to provide the desired flow influencing characteristics. An actuator plate 28 may be disposed adjacent the vane ring 24 with an actuation mechanism 30 including elements disposed between the actuator plate 28 and the vane ring 24. The actuation mechanism may include a set of elements comprising a pair of levers 32, 34 and an arm, 36 corresponding to each individual vane 22. The arms 36 may be used to translate the levers 32, 34 thereby rotating the shaft 26 and as a result, the corresponding vane 22 as well. Rotation of the vanes 22 alters their orientation relative to the incoming exhaust gas stream and changes the rotational response of the turbine wheel assembly 14.

In FIG. 1, the vanes 22 are shown in an open state allowing exhaust gas to flow in between each adjacent set of vanes. The vanes 22 may result in a varying response by changing the angle of incidence of the exhaust gas flow into the turbine wheel assembly 14 so as to present an instantaneously desired turbine size. Variability allows the flow area of the turbine wheel assembly 14, and thereby its flow mass, to be optimized to the associated operating engine's varying load profile. It should be understood that the vanes 22 may be rotated to a number of open positions and a closed position.

Figure 2:
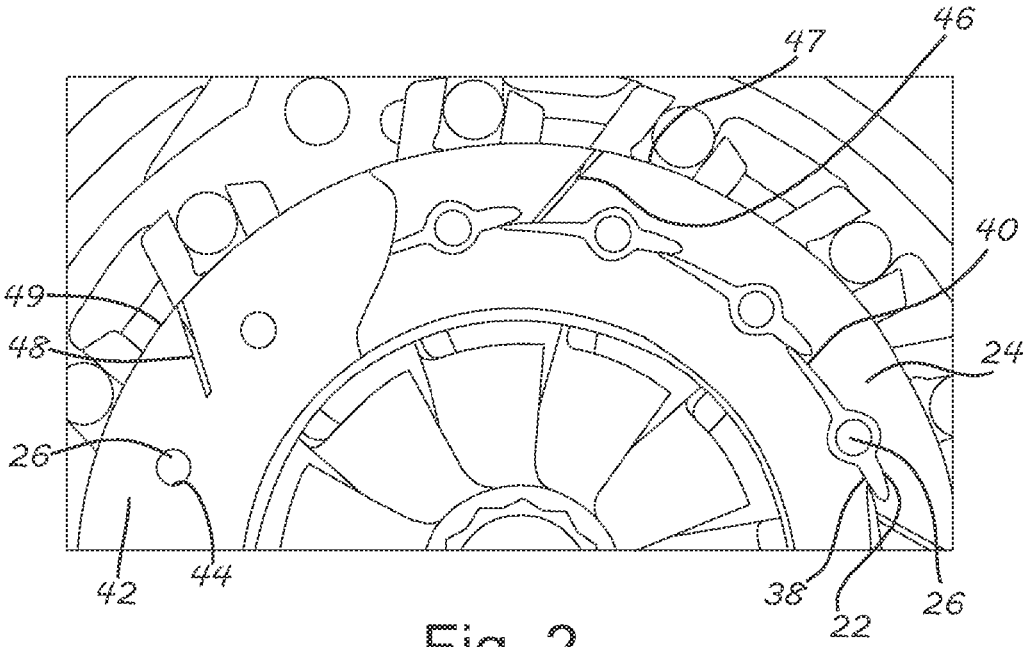
FIG. 2 is a fragmentary illustration of a turbine area of a turbocharger with vanes in a closed state according to a number of variations, and with the turbine housing removed.

In FIG. 2, the vanes 22 are shown in a closed state. For each vane 22, its radially inside leading edge 38 may contact an adjacent vane, and its radially outside trailing edge 40 may contact the opposite adjacent vane, thereby closing the flow path. Shown fragmented in FIG. 2 is the complementary vane ring 42 that in cooperation with the vane ring 24 channels the flowing exhaust gases through the flow path between the vane rings and over the vanes 22. The vanes 22 are disposed between the vane rings 42, 24 with tight side clearance to minimize leakage past the vane sides. In addition, the vane rings 42, 24 may have tightly toleranced openings 44 that locate the vanes 22 via the shafts 26. It has been found that extreme environmental stress on the turbine wheel assembly 14 may result in deformation of the vane rings 42, 24 during heating and cooling. Deformation may surpass the available clearance between the vanes 22 and the vane rings 42, 24 or between the shafts 26 and the vane rings 42, 24.

To control the direction of expansion and contraction, a number of slots 46 may be formed in the vane ring 24, as illustrated from its outer circumference 47. Similarly, a number of slots 48 may be formed in the vane ring 42 from its outer circumference 49. The slots may be positioned on opposite sides of the three fasteners 25 which restrain the vane ring 24, in each case on the opposite side of the vane 22 immediately adjacent the fastener 25. The slots 46, 48 may extend into the respective vane ring from the outer circumference to a depth defined by a diameter extending through the shafts 26, so that the radial inside end of the slots 46, 48 is radially inside the shafts 26. The slots 46, 48 may be angled in the same or similar directional orientation as that of the open vanes 22 of FIG. 1, so as to not impart undesirable turbulence. The specific geometry of the slots 46, 48 may be optimized for different variable turbine geometry sizes and applications. Deformation of the vane rings 42, 24 may be directed in the radial direction by the slots 46, 48, to reduce thermal buckling (both axisymmetric and non-axisymmetric), which may otherwise result in binding of the vanes 22. In other applications the slots may extend only partially through the thickness of the vane rings, and may be located on the surface of the vane rings opposite the vanes or on the surface facing the vanes. The slots may be cut from the inner circumference, or both the inner and outer circumferences, and may be oriented in a variety of directions.

The following description of variants is only illustrative of components, elements, acts, product and methods considered to be within the scope of the invention and are not in any way intended to limit such scope by what is specifically disclosed or not expressly set forth. The components, elements, acts, product and methods as described herein may be combined and rearranged other than as expressly described herein and still are considered to be within the scope of the invention.

Variation 1 may involve a product for a turbocharger assembly that may include a turbine wheel assembly that may be adapted to rotate when exposed to a flow of gas. A vane ring may be disposed in the turbine wheel assembly. A plurality of vanes may be mounted to the vane ring. The flow of gas may meet the plurality of vanes at an angle of incidence. The plurality of vanes may be adjustable to selectively change the angle of incidence. The vane ring may have at least one slot adapted to direct a thermal deformation of the vane ring in a selected direction when exposed to the flow of gas.

Variation 2 may include a product according to variation 1 wherein the vane ring may have a thickness and wherein the slot may extend completely through the thickness.

Variation 3 may include a product according to variation 1 or 2 and may include a second vane ring in the turbine wheel assembly disposed so that the plurality of vanes are positioned between the first and second vane rings and the flow of gas is directed between the first and second vane rings.

Variation 4 may include a product according to variation 3 wherein the second vane ring may have at least one slot adapted to direct the thermal deformation of the vane ring in the selected direction when exposed to the flow of gas, the selected direction being selected so that the thermal deformation does not create a bind between the plurality of vanes and the first and second vane rings.

Variation 5 may include a product according to any of variations 1 through 4 wherein the plurality of vanes may be positioned in an open condition. Each vane in the plurality of vanes may be positioned in a directional orientation relative to the vane ring and the slot may be substantially disposed in the directional orientation.

Variation 6 may include a product according to any of variations 1 through 5 wherein the vane ring may include a plurality of openings and wherein each vane in the plurality of vanes may be mounted to the vane ring by a rotatable shaft that extends through one of the plurality of openings.

Variation 7 may include a product according to variation 6 wherein a clearance may be provided between the vane ring and each shaft in the plurality of shafts, and wherein the clearance may be maintained during the thermal deformation as a result of inclusion of the slot.

Variation 8 may include a product according to any of variations 1 through 7 wherein a clearance may be provided between the vane ring and each vane in the plurality of vanes, and wherein the clearance may be maintained during the thermal deformation as a result of inclusion of the slot.

Variation 9 may include a product according to any of variations 1 through 8 wherein an actuating mechanism may be positioned in the turbine wheel assembly, wherein the actuating mechanism may be configured to adjust the plurality of vanes.

Variation 10 may include a product according to variation 9 and may include an actuator plate positioned in the turbine wheel assembly. The actuating mechanism may include a number of levers positioned between the actuator plate and the vane ring. The levers may be configured to rotate the plurality of vanes.

Variation 11 may involve a product for a turbocharger assembly that may include a turbine wheel assembly adapted to rotate when exposed to a flow of gas. A first vane ring may be disposed in the turbine wheel assembly. A second vane ring may be disposed in the turbine wheel assembly. The second vane ring may be spaced apart from the first vane ring defining a flow path between the first and second vane rings. A plurality of vanes may be mounted in the flow path. The plurality of vanes may be adjustable between a range of positions to vary the flow path. Each of the first and second vane rings may have at least one slot adapted to direct a thermal deformation of the vane ring in a selected direction when exposed to the flow of gas.

Variation 12 may include a product according to variation 11 wherein each of the first and second vane rings may have an outer circumference and wherein the at least one slot in the first and second vane rings may extend from the outer circumference into the vane rings.

Variation 13 may include a product according to variation 12 wherein each of the plurality of vanes may be mounted on a shaft. A diameter may be defined around the first and second vane rings that extends through the shaft. The slots in the first and second vane rings may extend from the outer circumference to the diameter.

Variation 14 may include a product according to any of variations 11 through 13 wherein the first vane ring may be connected in the turbine wheel assembly by a number of fasteners. A slot may be positioned on each side of each of the fasteners.

Variation 15 may involve a turbine wheel assembly for a turbocharger that may include a hub that may have a number of fixed outlet vanes. A vane ring may be disposed around the hub. The vane ring may include a number of variable inlet vanes. The turbine wheel assembly may rotate as a result of a flow of gas entering the turbine wheel assembly around the number of variable inlet vanes and exiting the turbine wheel assembly around the number of fixed outlet vanes. The number of variable inlet vanes and the number of fixed outlet vanes may influence the flow of gas. The vane ring may include a number of slots adapted to direct a thermal deformation of the vane ring in a selected direction when exposed to the flow of gas.

The above description of select variations within the scope of the invention is merely illustrative in nature and, thus, variations or variants thereof are not to be regarded as a departure from the spirit and scope of the invention.

What is claimed is:

1. A product for a turbocharger assembly comprising:

a turbine wheel assembly adapted to rotate when exposed to a flow of gas;

a vane ring disposed in the turbine wheel assembly and having an outer circumference radially spaced from a housing;

a plurality of vanes mounted to the vane ring, wherein the flow of gas meets the plurality of vanes at an angle of incidence, the plurality of vanes being adjustable to selectively change the angle of incidence;

wherein the vane ring has at least one slot that is elongated and adapted to direct a thermal deformation of the vane ring in a selected direction when exposed to the flow of gas, and wherein the vane ring includes a plurality of openings and wherein each vane in the plurality of vanes is mounted to the vane ring by a rotatable shaft that extends through one of the plurality of openings, and each slot is disposed between two of the plurality of openings, respectively;

wherein the vane ring is a first vane ring and further comprising a second vane ring in the turbine wheel assembly disposed so that the plurality of vanes are positioned between the first and second vane rings and the flow of gas is directed between the first and second vane rings.

2. The product according to claim 1 wherein the vane ring has a thickness and wherein the slot extends completely through the thickness.

3. The product according to claim 1 wherein the second vane ring has at least one slot adapted to direct the thermal deformation of the vane ring in the selected direction when exposed to the flow of gas, the selected direction being selected so that the thermal deformation does not create a bind between the plurality of vanes and the first and second vane rings.

4. The product according to claim 1 wherein the plurality of vanes are each positionable in an open condition where each vane in the plurality of vanes is positioned in a directional orientation relative to the vane ring and wherein the slot is substantially disposed in the directional orientation.

5. The product according to claim 1 wherein each shaft in the plurality of shafts rotates in an opening of the plurality of openings and wherein the rotation is maintained during the thermal deformation as a result of inclusion of the slot.

6. The product according to claim 1 wherein each vane in the plurality of vanes is mounted to rotate on the vane ring and wherein rotation is maintained during the thermal deformation as a result of inclusion of the slot.

7. The product according to claim 1 wherein an actuating mechanism is positioned in the turbine wheel assembly, the actuating mechanism configured to adjust the plurality of vanes.

8. The product according to claim 7 further comprising an actuator plate positioned in the turbine wheel assembly wherein the actuating mechanism includes a number of levers positioned between the actuator plate and the vane ring, wherein the levers are configured to rotate the plurality of vanes.

9. A product for a turbocharger assembly comprising:

a turbine wheel assembly adapted to rotate when exposed to a flow of gas;

a first vane ring disposed in the turbine wheel assembly;

a second vane ring disposed in the turbine wheel assembly, the second vane ring spaced apart from the first vane ring defining a flow path between the first and second vane rings;

a plurality of vanes mounted in the flow path, the plurality of vanes being adjustable between a range of positions to vary the flow path;

wherein each of the first and second vane rings has at least one slot adapted to direct a thermal deformation of the vane ring in a selected direction when exposed to the flow of gas wherein each of the first and second vane rings has an outer circumference and wherein the at least one slot in the first and second vane rings extends from the outer circumference into the first and second vane rings.

10. The product according to claim 9 wherein each of the plurality of vanes is mounted on a shaft and wherein a diameter is defined around the first and second vane rings that extends through the shaft, and wherein the at least one slot in the first and second vane rings extends to the diameter.

11. The product according to claim 9 wherein the first vane ring is connected in the turbine wheel assembly by a number of fasteners and wherein the at least one slot of the first vane ring includes a slot on each side of each of the number of fasteners.

12. A turbine wheel assembly for a turbocharger comprising:

a hub that has a number of outlet vanes fixed thereto;

a vane ring disposed around the hub, wherein the vane ring includes a number of variable inlet vanes and having an outer circumference radially spaced from a housing;

wherein the hub rotates as a result of a flow of gas entering the turbine wheel assembly around the number of variable inlet vanes and exiting the turbine wheel assembly around the number of fixed outlet vanes, wherein the number of variable inlet vanes and the number of fixed outlet vanes influences the flow of gas;

wherein the vane ring includes a number of slots adapted to direct a thermal deformation of the vane ring in a selected direction when exposed to the flow of gas;

wherein the vane ring includes a plurality of openings and wherein each of the variable inlet vanes is mounted to the vane ring by a rotatable shaft that extends through one of the plurality of openings, and each slot is disposed between two of the plurality of openings, respectively;

wherein the vane ring is a first vane ring and further comprising a second vane ring in the turbine wheel assembly disposed so that the plurality of vanes are positioned between the first and second vane rings and the flow of gas is directed between the first and second vane rings.

* * * * *